US007467673B2

(12) United States Patent
Earles et al.

(10) Patent No.: US 7,467,673 B2
(45) Date of Patent: Dec. 23, 2008

(54) ROTARY VECTOR GEAR FOR USE IN ROTARY STEERABLE TOOLS

(75) Inventors: Ronald G. Earles, Houston, TX (US); Jeffrey B. Lasater, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 334 days.

(21) Appl. No.: 10/597,481

(22) PCT Filed: Jan. 28, 2005

(86) PCT No.: PCT/US2005/003520

§ 371 (c)(1),
(2), (4) Date: Jul. 27, 2006

(87) PCT Pub. No.: WO2005/099424

PCT Pub. Date: Oct. 27, 2005

(65) Prior Publication Data

US 2008/0190665 A1 Aug. 14, 2008

Related U.S. Application Data

(60) Provisional application No. 60/539,834, filed on Jan. 28, 2004.

(51) Int. Cl.
*E21B 7/06* (2006.01)

(52) U.S. Cl. ..... 175/82; 464/109

(58) Field of Classification Search ..... 175/82, 175/83, 95, 101; 166/66.4; 74/500.5, 502.6; 464/52, 53, 109

See application file for complete search history.

(56) References Cited

U.S. PATENT DOCUMENTS 5,979,570 A 11/1999 McLoughlin et al.
6,244,361 B1 6/2001 Comeau et al.
6,808,027 B2 10/2004 McLoughlin et al.

*Primary Examiner*—Jennifer H Gay
*Assistant Examiner*—Daniel P Stephenson
(74) *Attorney, Agent, or Firm*—Conley Rose, P.C.

(57) ABSTRACT

A rotary vector gear for controlling longitudinal axis offset about a central longitudinal axis is disclosed. The device uses single rotary motion through a rotary vector gear to produce hypotrochoidic offset similar to a flower petal and is capable or ready return to zero offset. The device may be used in downhole rotary steerable oil and gas drilling tools and in computer controlled milling machines for providing controlled offset.

21 Claims, 10 Drawing Sheets

ROTARY VECTOR GEAR FOR USE IN ROTARY STEERABLE TOOLS

TECHNICAL FIELD OF THE INVENTION

The present invention relates to the field of oil and gas drilling. More specifically the present invention relates to an apparatus and method for selecting or controlling, from the surface, the direction in which a wellbore proceeds.

BACKGROUND OF THE INVENTION

A drill operator often wishes to deviate a wellbore or control its direction to a given point within a producing formation. This operation is known as directional drilling. One example of this is for a water, injection well in an oil field, which is generally positioned at the edges of thee field and at a low point in that field (or formation).

In addition to controlling the required drilling direction, the formation through which a wellbore is drilled exerts a variable force on the drill string at all times. Tins along with the particular configuration of the drill can cause the drill bit to wander up, down, right or left. The industrial term given to this effect is "bit-walk" and many methods to control or re-direct "bit-walk" have been tried in the industry. The effect of bit walk in a vertical hole can be controlled, by varying the torque and weight on the bit while drilling a vertical hole. However, in a highly inclined or horizontal well, bit-walk becomes a major problem.

At present, in order to deviate a hole left or right, the driller can choose from a series of special downhole tools such as downhole motors, so-called "bent subs" and more recently rotary steerable tools.

A bent sub is a short tubular that has a slight bend to one side, is attached to the drill string, followed by a survey instrument, of which an MWD tool (Measurement While Drilling which passes wellbore directional information to the surface) is one generic type, followed by a downhole motor attached to the drill bit. The drill string is lowered into the wellbore and rotated until the MWD tool indicates that the leading edge of the drill bit is facing in the desired direction. Weight is applied to the bit through the drill collars. And, by pumping drilling fluid through the drill string, the downhole motor rotates the bit.

U.S. Pat. No. 3,561,549 relates to a device, which gives sufficient control to deviate and start an inclined hole from or control bit-walk in a vertical wellbore. The drilling tool has a non-rotating sleeve with a plurality of fins (or wedges) on one side is placed immediately below a downhole motor in turn attached to a bit.

U.S. Pat. No. 4,220,213 relates to a device, which comprises a weighted mandrel. The tool is designed to take advantage of gravity because the heavy side of the mandrel will seek the low-side of the hole. The low side of the wellbore is defined as the side farthest away from the vertical.

U.S. Pat. No. 4,638,873 relates to a tool, which has a spring-loaded shoe and a weighted heavy side, which can accommodate a gauge insert held in place by a retaining bolt.

U.S. Pat. No. 5,220,963 discloses an apparatus having an inner rotating mandrel housed in three non-rotating elements.

Thus, it is known how to correct a bit-walk in a wellbore. However, if changes in the forces that cause bit-walk occur while drilling, all the prior art tools must be withdrawn in order to correct the direction of the wellbore. The absolute requirement for tool withdrawal means that a round trip must be performed. This results in a compromise of safety and a large expenditure of time and money.

U.S. Pat. No. 5,979,570 (also WO 96/31679) partially address the problem of bit-walk in an inclined wellbore. The device described in this patent application and patent comprises eccentrically bored inner and outer sleeves. The outer sleeve being freely moveable so that it can seek the low side of the wellbore, the weighted side of the inner eccentric sleeve being capable of being positioned either on the right side or the left side of the weighted portion of the outer eccentric sleeve to correct in a binary manner for bit walk.

U.S. Pat. No. 6,808,027 (one of the co-inventors of which is a co-inventor of the instant application) discloses an improved downhole tool which can correct for bit walk in a highly inclined wellbore and which is capable of controlling both the inclination and the azimuthal plane of the well bore. Whereas U.S. Pat. No. 5,979,570 discloses bit offset, the '027 patent discloses a vector approach (the actual improvement) called bit point. The '027 patent uses a series of sleeves (or cams depending on the definition of the term) that may be eccentric or concentric to obtain bit point (the improvement) or bit offset disclosed in the earlier patent, but obtained by a different mechanical device).

The instant application discloses a different mechanical technique to obtain the rotary vector within the downhole tool and may be employed in the apparatus of U.S. Pat. No. 6,808,027, U.S. Pat. No. 5,979,570 and other downhole equipment (using stabilizers, blades and the like) that require an internal positioning mechanism.

SUMMARY OF THE INVENTION

The device, defined as a Cycloid System, Rotary Vector Gear or Hypotrochoidic Drive, provides an apparatus for selectively controlling the offset of a longitudinal axis, comprising:

- a Concentric Driven Inner Sleeve;
- a First Stage Eccentric Sleeve connected to said driven inner sleeve;
- a Second Stage Eccentric Sleeve;
- an External tooth Cycloid Disc, attached to said second stage eccentric;
- an internal tooth Cycloid Ring (Stationary Ring or Roller Assembly) attached to an outer housing for retaining the cycloid system; and,
- a driver and control means for rotating said driven inner sleeve,
  - wherein said cycloid system provides progressive longitudinal axis depending on the configuration of the cycloid system.

The cycloid device may be used as a single unit or a dual unit within a rotary steerable tool (although options involving a plurality of devices within an assembly can be envisioned) to provide bit point of bit push. If a single unit is utilized the cycloid system will provide bit point offset vector steering within the wellbore; whereas, a dual cycloid system will provide bit push offset vector steering within the wellbore. The use of cycloid devices within downhole steering tools allows the operator to vary the dog-leg severity (or magnitude of wellbore curvature) during the drilling operation; whereas, current steering tools have fixed dog-leg severity which can only be varied when the steering tool is brought to the surface. The device may also be used within computer controlled milling machines and the like In the preferred mode, when used in a rotary steerable tool, the device can control the wellbore path. Sensors may be mounted in the cycloid device or within the housing of the rotary steerable tool that provide wellbore path reference data (I.e., up/down, north/south, east/west, plus other required geophysical data). This data may then be linked through the control system to provide real-time adjustments to the cycloid gear thereby controlling the wellbore path. A communication link may be established with a communication protocol that will allow real-time communication between the rotary steerable tool and the surface thereby providing further wellbore path control and control of the dog-leg severity of the wellbore path.

DETAILED DESCRIPTION OF THE INVENTION

Figure 5:
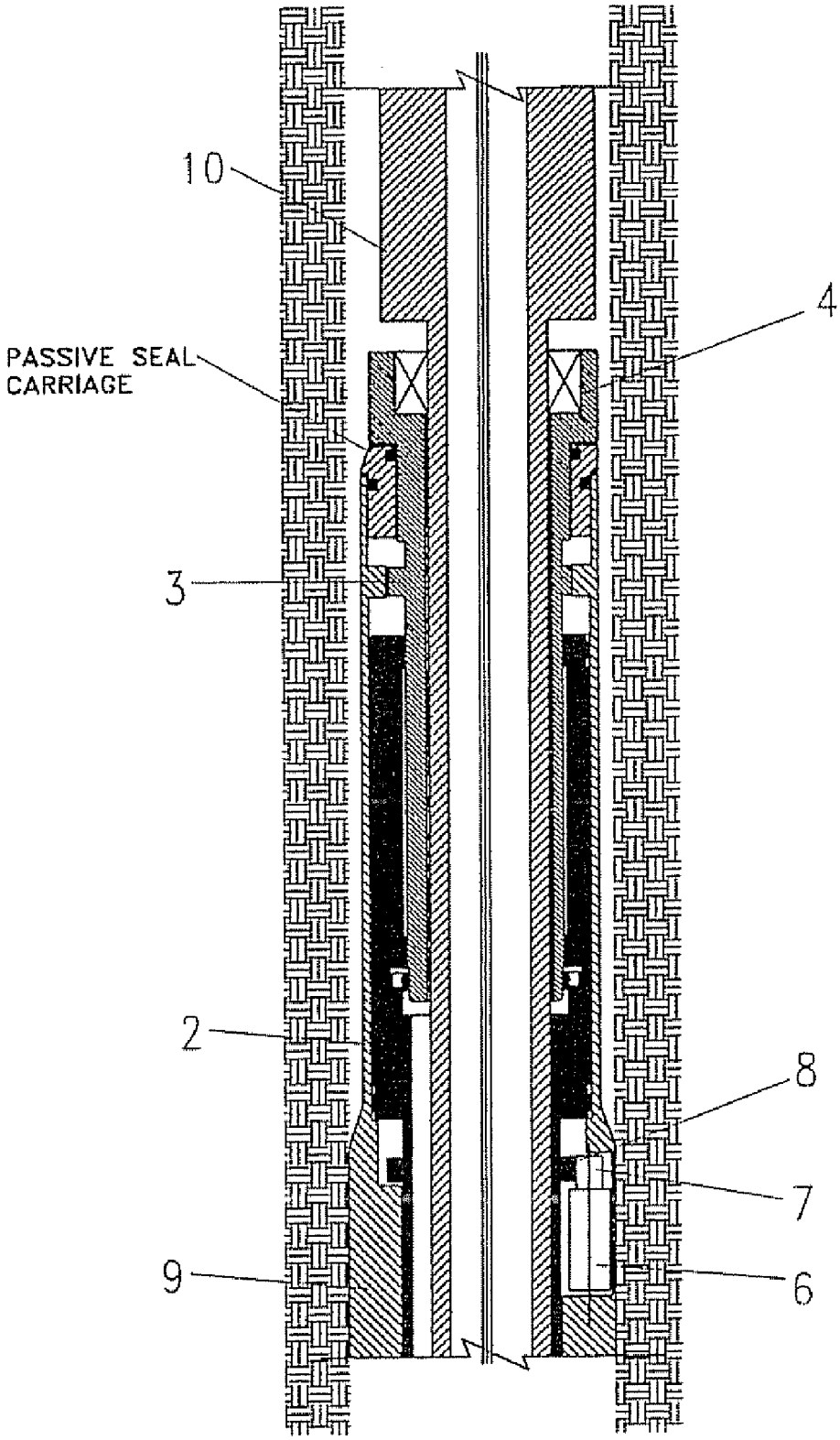
FIG. 5 shows the instant device installed in a downhole tool (describing the embodiment that uses two cycloid devices—one at either end.

The system will be described assuming that it will be used in a downhole rotary steering tool; however, it should be understood that the cycloid drive system may be used in other apparatuses to provide progressive control of the offset of the longitudinal axis. The cycloid or rotary vector gear system is enclosed in an outer housing that is approximately 12 feet in length that is made up from seven pinned or threaded section sections. The total length of the tool is approximately 16 feet. FIG. 5 shows the cycloid system contained within a rotary steerable tool that utilizes an offset outer housing to interact with the wall of the wellbore thereby providing the fulcrum for bit vectoring.

Referring now to FIGS. 1-4, the cycloid device consists of six major components:

a Concentric Input Sleeve, 1, or Rotary Sleeve, a First Stage Eccentric Sleeve, 2, that is joined to the input sleeve, 1, and is sometimes referred to as the Inner Sleeve), an External Tooth Cycloid Disc, 3, a Second Stage Eccentric Sleeve, 4, sometimes referred to as the Output or Bulkhead, an Internal Tooth Cycloid Ring, 5, or Roller Assembly, and a driver and control means, 6-8, for rotating the inner sleeve.

The internal tooth cycloid ring, 5, is retained within an outer housing, 9. The outer housing would normally be the actual downhole tool that contains the cycloid system(s), batteries and the like and provides the necessary fulcrum to the drill string. If the cycloid system is utilized in another device, then that device would provide the outer housing.

The driver is usually a brushless DC motor, 6, coupled to a shaft and gear assembly, 7, that in turn drives a gear wheel, 8, that is directly attached to the concentric input sleeve, 1. The control assembly, while not forming a part of the instant device is critical to the operation of the device. The control assembly consists of telemetry systems and batteries that respond to control inputs from the surface and drive the brushless DC motor, 6, that in turn positions the cyclic drive thereby imparting the required bit vector the downhole drill bit.

The operation of the Hypotrochoidic Device will be now described. Referring to FIGS. 1 through 4, as the drive motor, 6, moves, the motion is imparted through the shaft/gear, 7, to the ring gear, 8, on the concentric sleeve, 1, thereby rotating both the concentric (drive) sleeve and the first stage eccentric sleeve, 2, about the longitudinal axis which passes through the center of the stationary cycloid ring, 5, which is essentially the longitudinal axis of the overall device. As the first stage eccentric sleeve, 2, rotates, it transfers motion to the second stage eccentric sleeve, 4, somewhat like a rotary crank handle. (Note the second stage eccentric sleeve is eccentric within the axis of the cycloid disk as will be explained and slightly offset from the longitudinal axis about which the concentric sleeve and first stage eccentric sleeve rotate). This causes the cycloid disk, 3, to move within the cycloid ring, 5. Because the two interacting sleeves are eccentric, the very slight axial movement of the cycloid disk causes the external teeth of the disk, 3, to move within the internal teeth of the stationary cycloid ring, 5. This action imparts a reverse motion (when compared to the motion of the concentric sleeve/first stage eccentric sleeve) about the longitudinal axis. (It should be noted that when the device is employed in a rotary steerable tool, the offset axis actually falls in the centerline of the wellbore; hence its use in drilling operations.)

The resulting action described above is similar to that of a wheel rolling along the inside of a ring. Thus as the wheel (Cycloid Disc, 3) travels in a clockwise motion around the ring (the cycloid ring, 5), the wheel turns in a counter-clockwise direction around its own axis. The external teeth of the Cycloid Disc, 3, encage successively with the internal teeth (or rollers) of the Stationary Cycloid Ring, 5, thus providing a reverse rotation at a reduced speed. For each complete revolution of the first stage eccentric sleeve, 2, the Cycloid Disc, 3, is advanced a distance of one tooth in the reverse direction. There is one less tooth in the Cycloid Disc than there are pins in the Roller Assembly, which results in reduction ratio equal to the number of teeth on the Cycloid Disc (approximately 20:1).

The combination of the roller assembly (cycloid ring, 5) and the disk (cycloid disk, 3) are referred to as a rotary vector gear. It should be noted that simple pins may be used within the roller assembly; however, friction forces will be greatly reduced through the use of roller pins.

Figure 11:
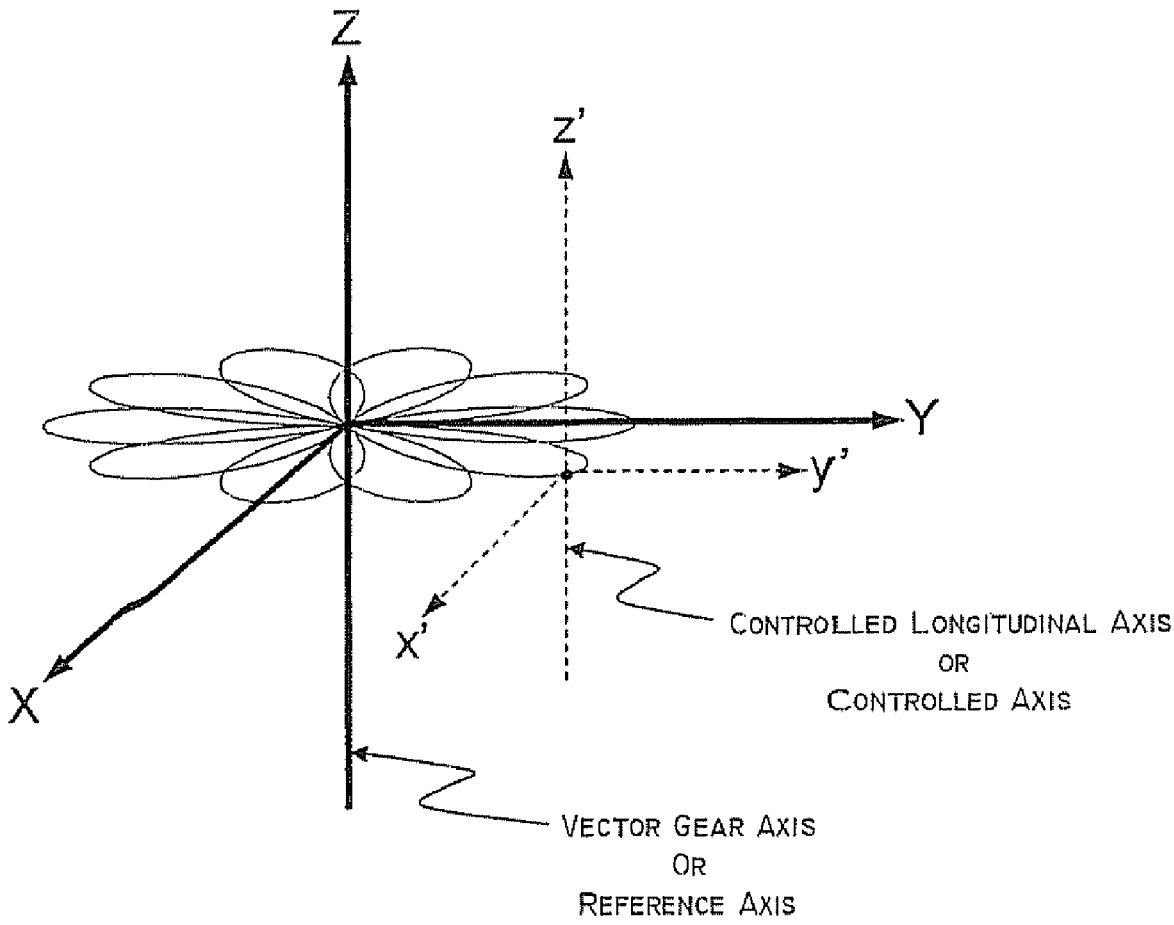
FIG. 11 illustrates the relation between the reference axis and the controlled axis of the instant device and shows the preferred hypotrochoidic movement used in a steerable tool.

Now it is important to study the second stage eccentric sleeve which effectively offsets the axis of the Cycloid Disc thereby imparting a second longitudinal axis parallel to the longitudinal axis of the rotary vector, gear taken through the center of the stationary roller, 5, that may referred to as the controlled longitudinal axis or the controlled axis. The longitudinal axis of the rotary vector gear may be referred to as the reference longitudinal axis or the reference axis FIG. 11 shows the two axes and the preferred hypochondriac pattern.

Figure 6:
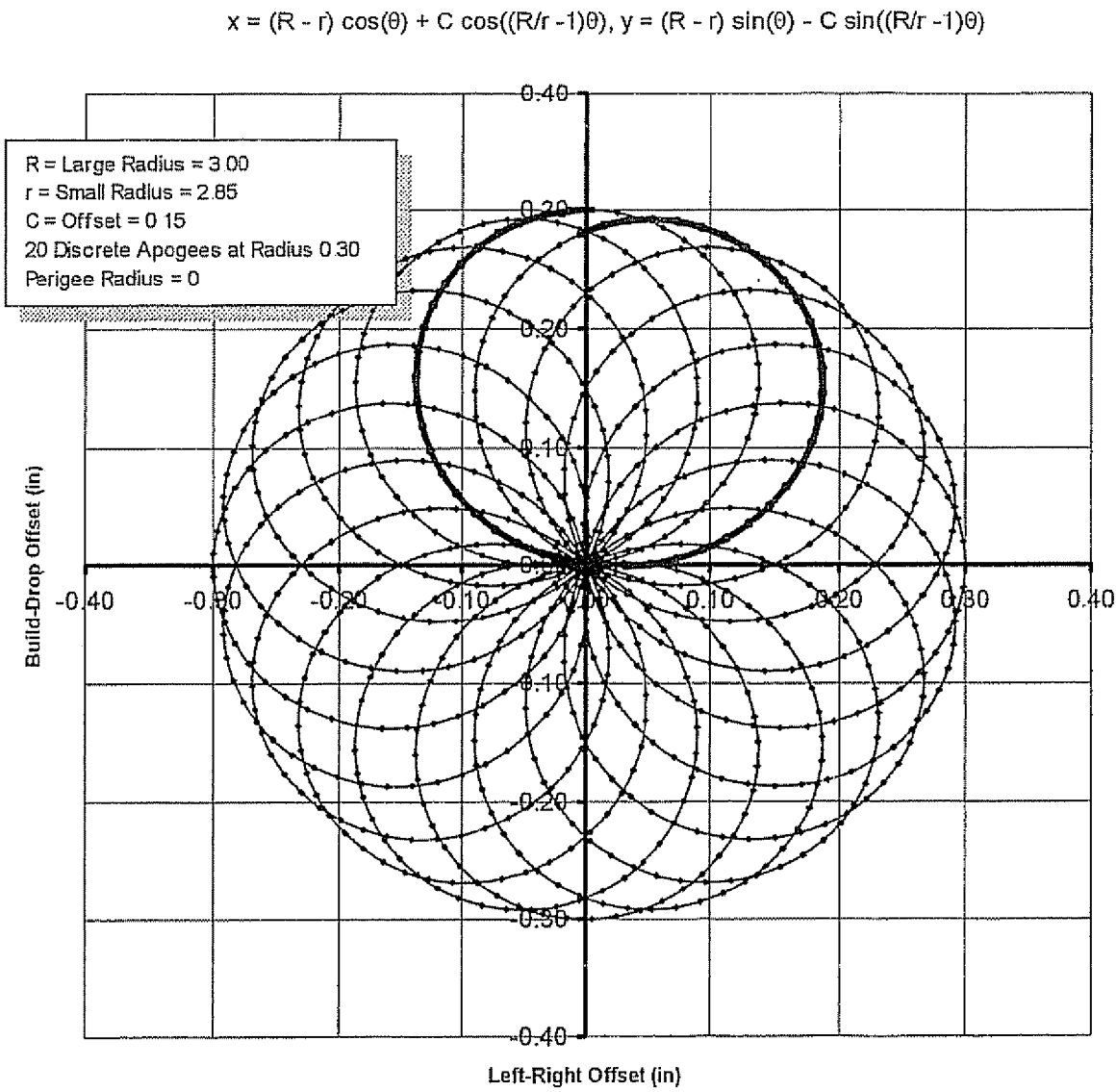
FIG. 6 shows the Hypotrochoidic Movement imparted to the center of the rotating mandrel by the cycloid disk being rolled inside the roller assembly.

In its preferred mode, the second or controlled axis is offset 150 inches. As shown in FIG. 6, when the Cycloid Disc is rotated, the controlled axis generates a Hypotrochoidic movement similar to the pattern of flower petals (corolla). The number of petals generated is determined by the size ratio (pitch diameter) between the Cycloid Disc and the Stationary Ring. This equation is R/(R−r) Where: R=the pitch diameter of the Stationary Ring and r=the pitch diameter of the Cycloid Disk. This Hypotrochoidic movement is transmitted through the Rotary Vector Gear Assembly (Cycloid Disc, 3, in combination with the Stationary Ring, 5) through the second stage eccentric, 4, (or bulkhead).

Figure 1:
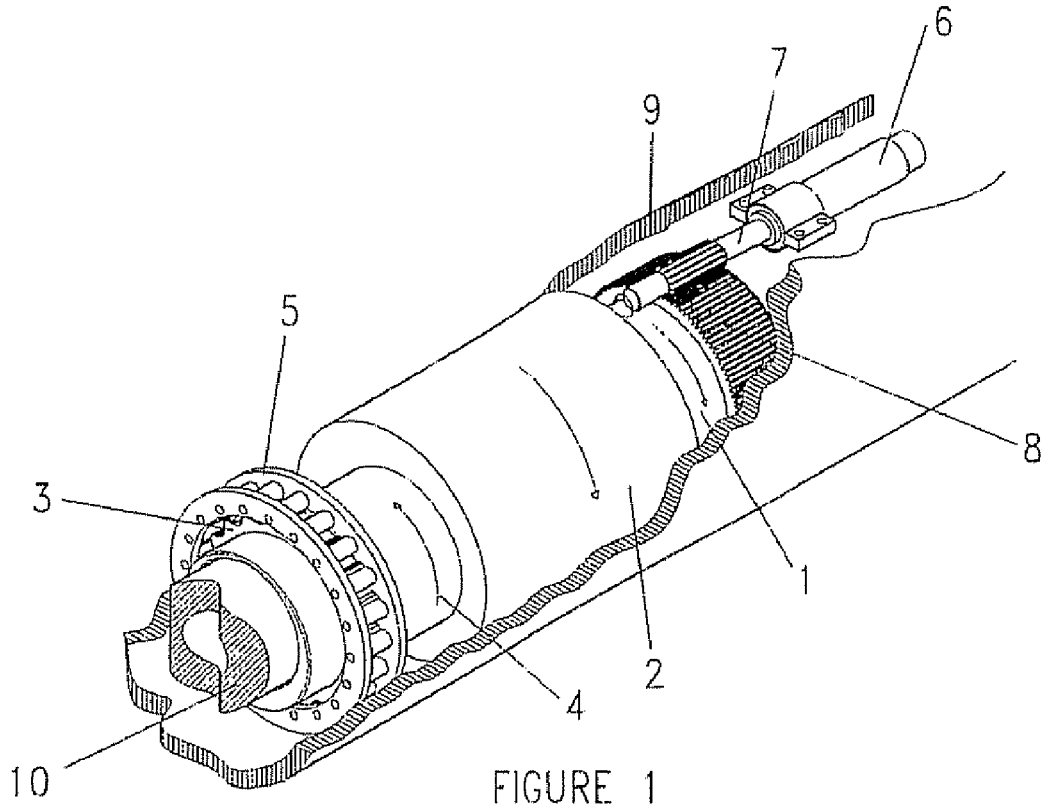
FIG. 1 is an isometric cutout of the instant device showing the stationary cycloid roller ring that runs against the outer housing, the concentric inner sleeve joined to the first stage rotary eccentric sleeve, the second stage eccentric sleeve, the inner rotating mandrel and just showing the internal cycloid disk.
Figure 2:
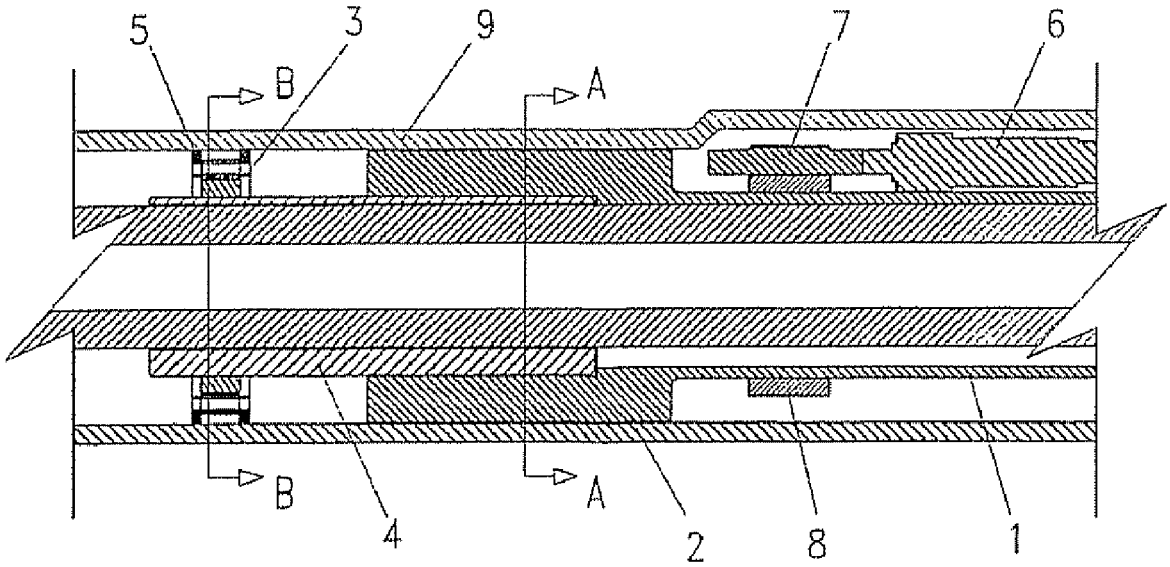
FIG. 2 is a cross-section side view of the instant device.
Figure 3:
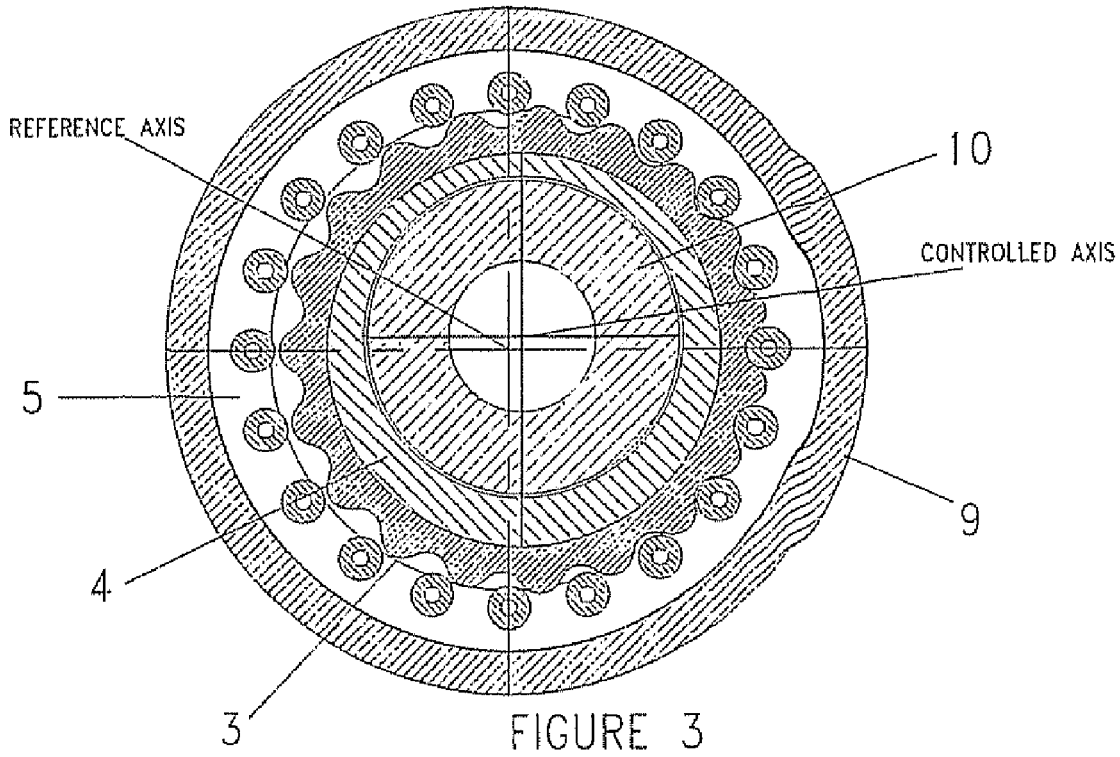
FIG. 3 is a cross-section, taken through A-A in FIG. 2, of the instant device showing the stationary cycloid roller ring running against the outer housing, the cycloid disk, the second stage eccentric sleeve and the inner rotating mandrel.
Figure 4:
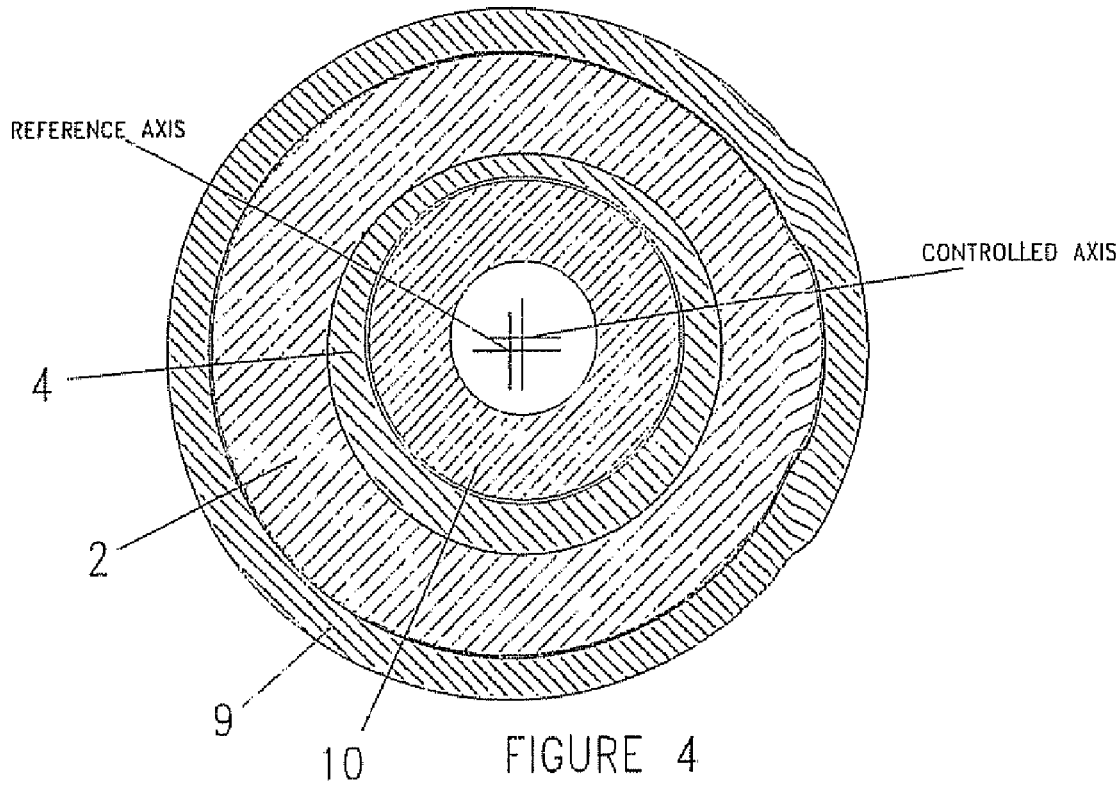
FIG. 4 is a cross-section, taken through B-B in FIG. 2 showing the outer housing, the first stage eccentric sleeve, the second stage eccentric sleeve and the inner rotating mandrel.

In looking at FIGS. 2-4, the reader should realize that FIG. 2 does not illustrate the eccentric within the First Stage Eccentric simply because this eccentric is rotated out-of-plane with the drawing. This eccentric is shown in the cross-sections of FIGS. 3 and 4.

In the preferred mode, used in a downhole rotary steerable tool as shown in FIG. 5, the second stage assembly contains a radial bearing that supports a Mandrel, 10. The mandrel is turn coupled to the drill string, thus the hypotrochoidic movement is transmitted to the drill string.

There is an inner relationship between the size ratio of the Cycloid Disc/Stationary Ring and the offset in the Cycloid Disc. For each rotation of the first eccentric stage one "flower petal" is generated, since it is desirable during this rotation that the drill string pass through a "0" offset (concentric), the dimension of the eccentric offset in the Cycloid Disc can only be half of the difference of the pitch diameters of the Cycloid Disc and the Stationary Ring.

Specifically, a rotary steerable design utilizing the vector rotary gear currently has a 5.7 inch [14.478 cm] diameter Cycloid Disc pitch diameter, and a 6.0 inch [15.24 cm] Stationary Ring pitch diameter with an offset of 150 [3.81 mm] in the Cycloid Disc. This creates an offset range of 0 to 3 inches [7.62 mm] with 20 headings at maximum offset(s), with sequentially processing rotation, as shown in FIG. 6. Sequential procession is important to efficiently and quickly correct for slow outer housing roll.

The first heading is shown using bold lines and represents one complete revolution of the driven inner sleeve. Each point on the first heading can be considered as corresponding with an interaction between and internal tooth and an external tooth within the rotary vector gears. Thus, starting at 0, 0 3 (standard xy-axis notation) and following the radius around it is possible to have offsets at varying points in the positive plane starting at 0, 0 3, going through roughly 0 13, 0 20, and passing through 0, 0, roughly −0 08, 0 20 and back to 0 0, 0 28. The next heading shifts towards the right and provides varying points. The control and driver system must then keep track of the number of turns of the inner driven sleeve which allows knowledge (to the control system) of the actual offset. Alternatively, sensors may be employed to provide knowledge of the position of the First Stage Eccentric and the Second Stage Eccentric thereby allowing the exact position of the offset to be determined.

Communication between a setpoint, external to the device, and the control and driver system is required. The external setpoint, in the case of a rotary steerable tool, would be the surface control unit. That unit, or the cycloid control system, must know how many turns of the inner sleeve have been commanded and then know how many turns will be required to position the offset in the required position. A modern computer based system will have no problem in tracking the current position of the vector rotary gear offset and will be capable of sending required information to the associated control drive system of the cycloid device.

In the preferred use of the device within a rotary steerable tool, if the known offset is then referenced to a gravity sensor or inertial control system, then the exact position of the controlled axis with reference to the wellbore centerline may be determined and controlled. The use of gravity senor or inertial control system will allow the drive and control means to compensate for slow roll of the rotary steerable device.

Figure 8:
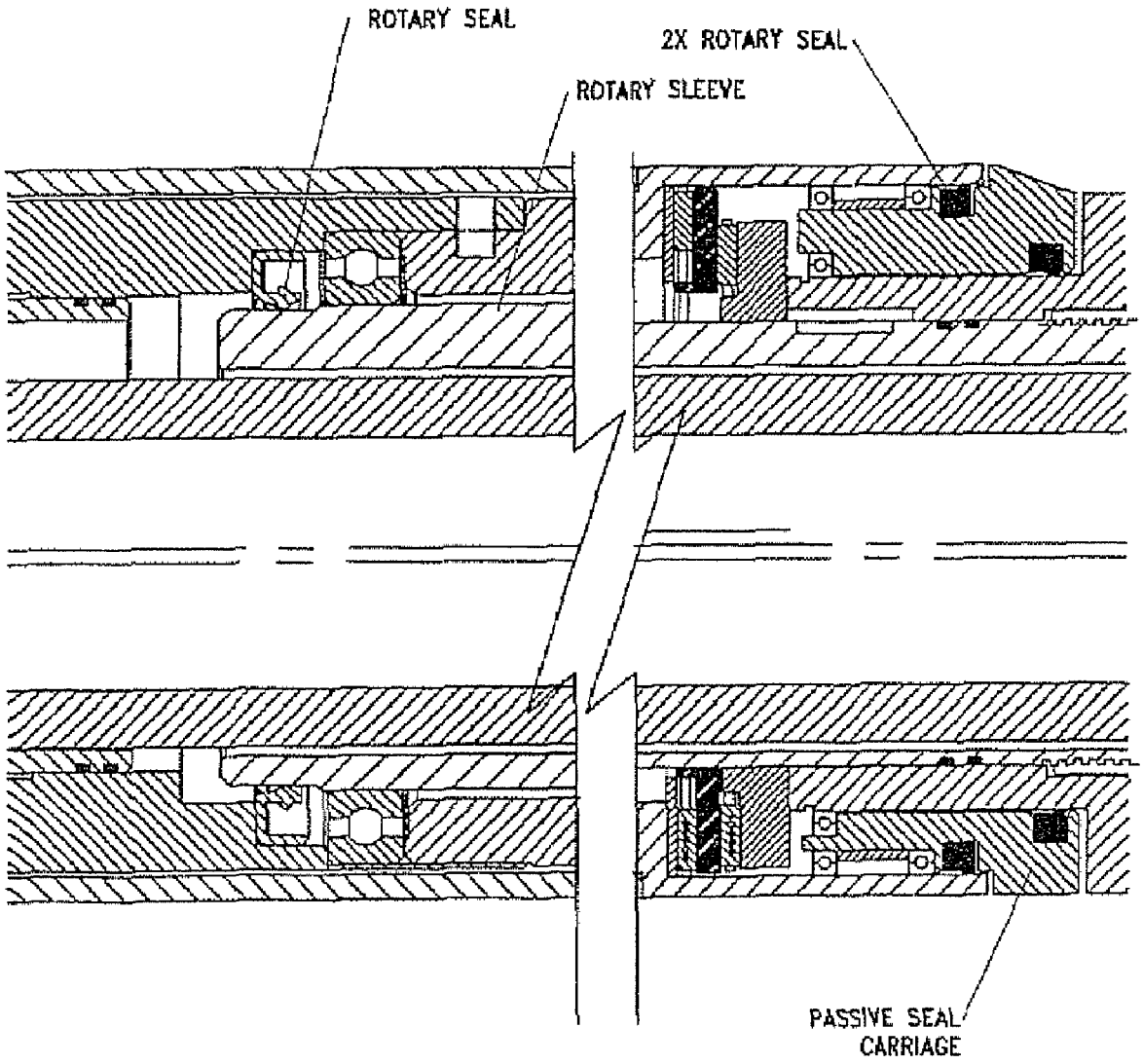
FIG. 8 shows further details of seals used within the instant device.

FIG. 8 shows a proposed layout for seals when the rotary vector gear is used in a downhole rotary steerable tool. The rotary steerable tool has 6 rotary seals and approximately 13 static seals. Other embodiments may use more or less rotary seals or static seals and the number of seals shown in FIG. 8 should not be read as a limitation. A separate pressure compensating mechanism, not shown, will be required to balance ambient and internal tool pressure.

Figure 9:
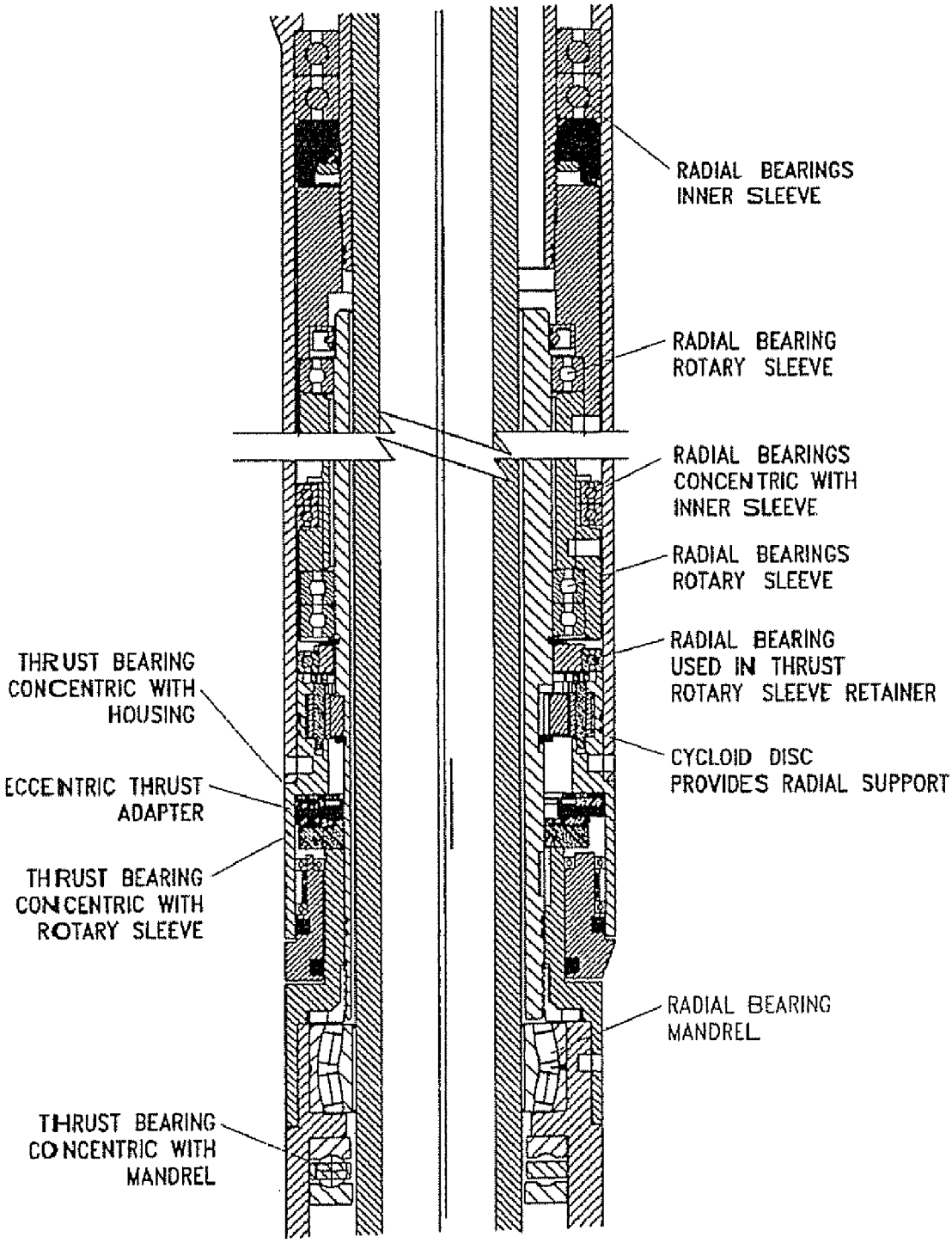
FIG. 9 shows further details for the bearing system used with a downhole tool exploiting the instant device.
Figure 10A:
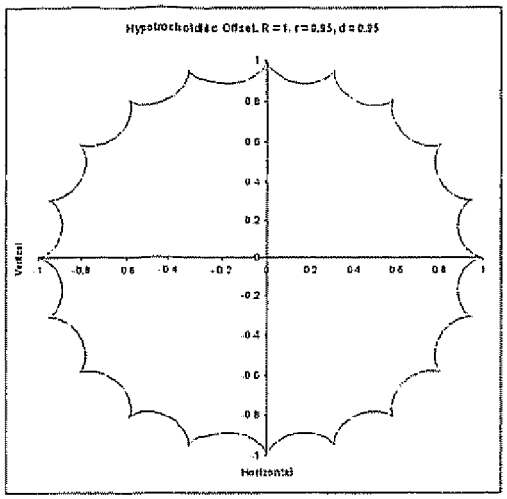
FIGS. 10A through 10F shows other patterns that may be imparted to the center (or longitudinal axis) of the cycloid disk.
Figure 10B:
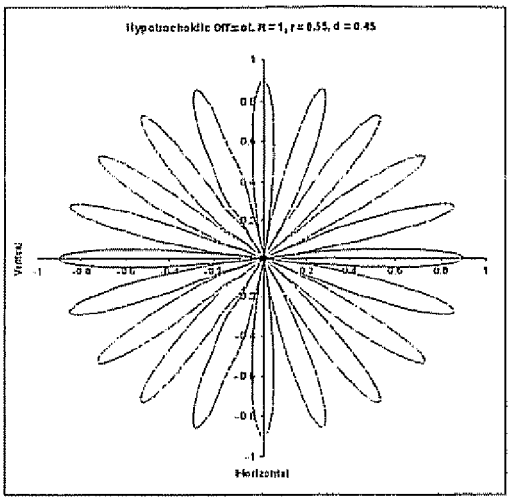
Figure 10C:
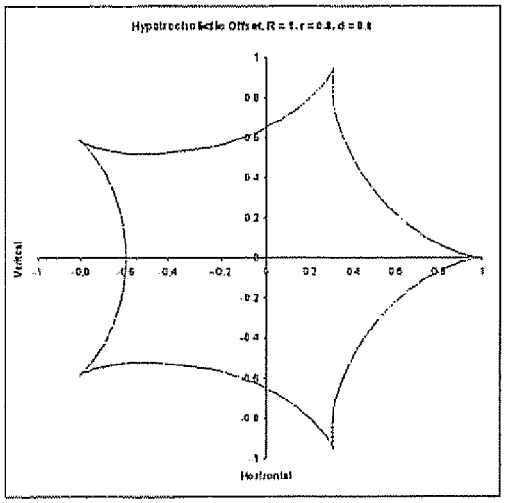
Figure 10D:
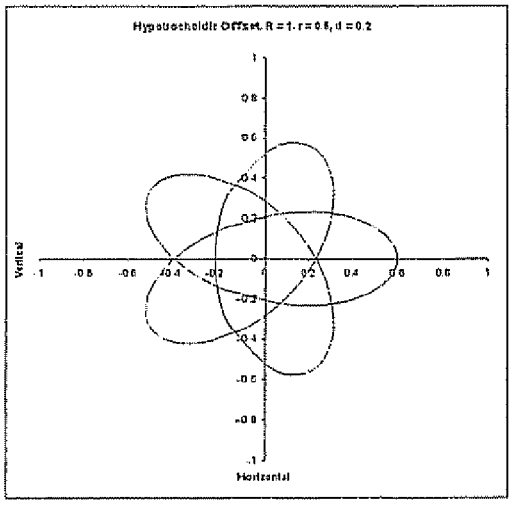
Figure 10E:
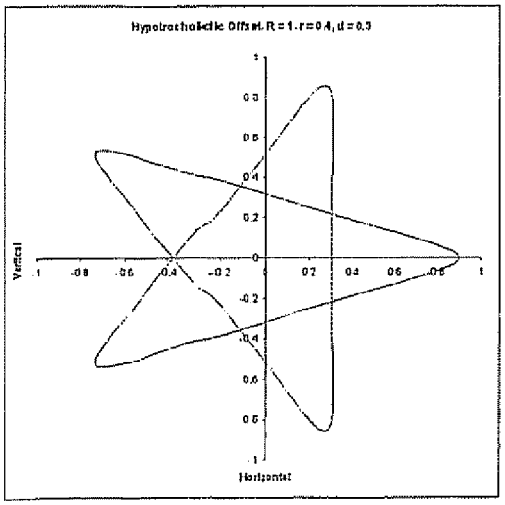
Figure 10F:
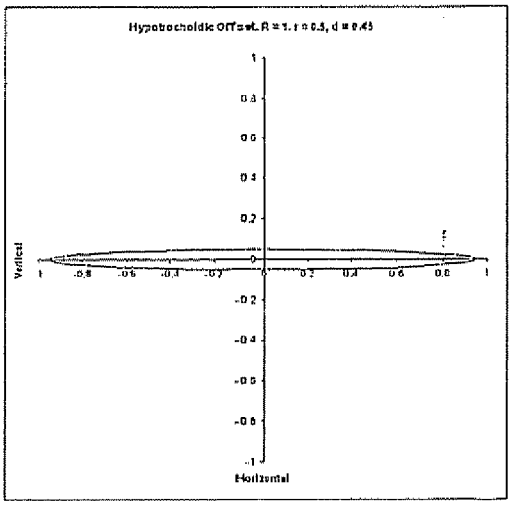

FIG. 9 shows a preferred bearing system for the rotary vector gear device as used in a downhole rotary steerable tool. Thrust and radial loads are transmitted through the housing first, through mud lubricated bearings that are concentric to the Mandrel, second, through sealed bearings that are concentric to the rotating sleeve, and finally through sealed thrust bearings that are concentric to the housing. Both distal and proximal ends of the tool have this bearing scheme.

Given the dimensional parameters, the Hypotrochoidic shape can be produced with the following parametric Cartesian equation: $x=(a-b)\cos(t)+c\cos((a/b-1)t)$, $y=(a-b)\sin(t)-c\sin((a/b-1)t)$. Where: a= is the radius of the Stationary Ring, b= is the radius of the Cycloid Disk and c= is the distance from the center of the Cycloid Disk to create the second, offset axis. The device computer would utilize this equation to translate number of turns of the inner sleeve to drive the cycloid disk so that the resulting Hypotrochoidic movement places the rotary vector in the required position. That is, the bit is vectored in the direction required by the drilling operation.

Figures 7A, 7B, 7C, 7F:
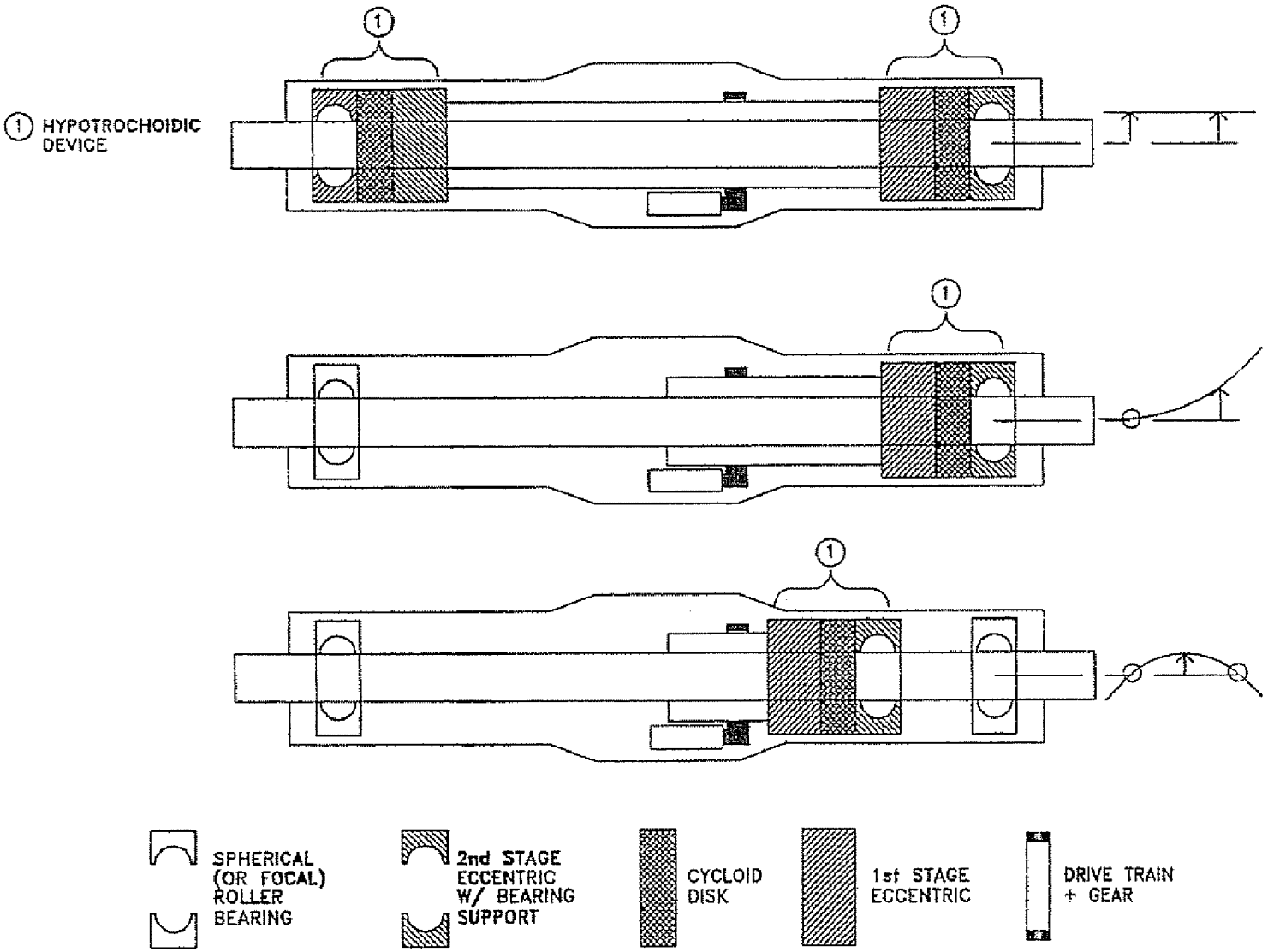
FIGS. 7A-F are highly simplified illustrations of various implementations of the instant device employed in a bladed downhole rotary steerable tool.
Figure 7D:
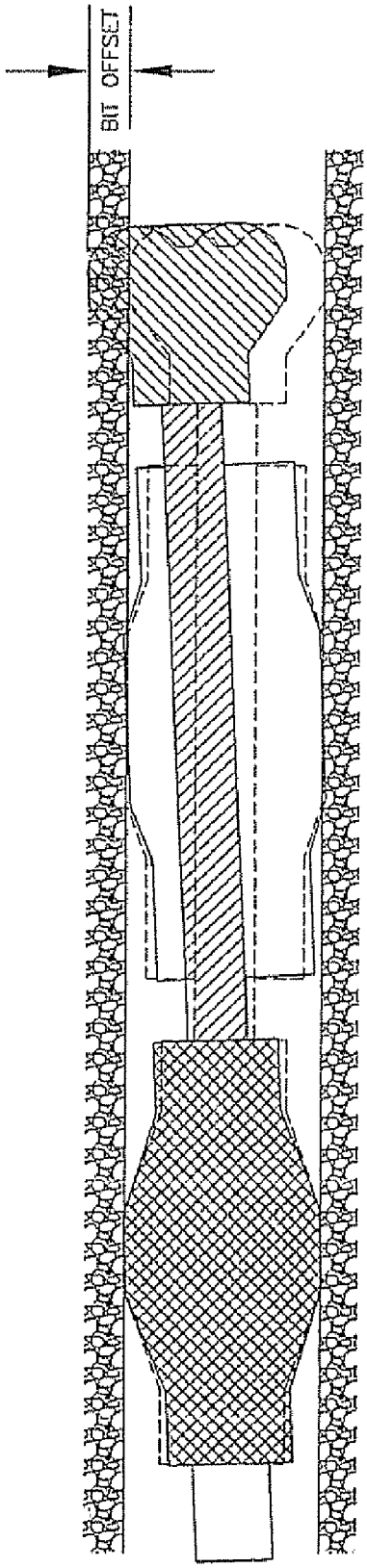
Figure 7E:
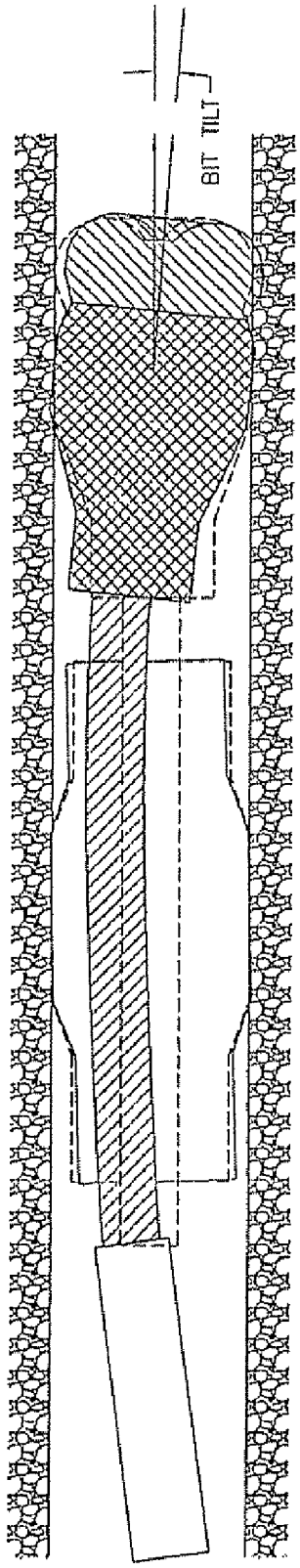

The concepts of bit offset and bit point (the so-called Rotary Vector) are described in U.S. Pat. No. 6,808,027 to McLoughlin et al. However, this rotary vector gear may be utilized in a rotary steerable tool to accomplish the same results. The use of such a rotary vector gear, is a great improvement in that the dog-leg severity may be adjusted within the tool from the surface. FIGS. 7A-7C show a simplified view of a rotary steerable tool employing the rotary vector gear of this disclosure; whereas, FIGS. 7D and 7E show exactly how bit point (bit tilt) and bit push are obtained by fulcrum action within a rotary steerable tool. FIG. 7E provide the key to the symbols used in FIGS. 7A-7C: namely the type of bearing (spherical roller, eccentric with a bearing, etc.), position of cycloid disk, $1^{st}$ stage eccentric and the like. FIG. 9 shows further bearing details.

FIG. 7A shows two rotary vector gear or cycloid devices (the system illustrated in FIGS. 1-4) installed in a downhole rotary steerable tool. This particular arrangement results in bit push. That is, the two cycloid disks operate together (i.e., they are co-joined to the same drive and control system) to offset the mandrel from the centerline of the wellbore.

FIG. 7B shows a single rotary vector gear or cycloid device and roller bearing support installed at opposite ends of a rotary steerable tool. This particular arrangement results in bit point. That is, the cycloid disk and single bearing operate together to point the mandrel away from the centerline of the wellbore.

FIG. 7C shows a single device installed at the center of a rotary steerable tool with the mandrel being supported at either end by bearing. The single device acts to push the mandrel off-center in the middle. This also results in bit point.

FIGS. 7D and 7E show how any of the above configurations may be used in conjunction with an external stabilizer to actually attain bit push or bit tilt (point). FIG. 7D —Bit Push— shows how a stabilizer placed above or behind a rotary tool employing the instant device will promote a lateral (or sideways) force on the bit. FIG. 7E—Bit Point— shows how a stabilizer placed (integral with the bit) between a rotary tool employing the instant device promotes an angular change (or bit point) on the bit.

It is important to realize that the instant device may be used in a rotary steerable tool that employs a pregnant (weighted) housing as described in previous U.S. patents (see the earlier discussion) in place of the sleeves (concentric and eccentric) or cams that yield the bit push and bit point configurations. (Here the word "cam" is used interchangeably with the word "sleeve.") The weighted—pregnant— housing tends towards the "lower side" of the wellbore. That is the weight of the housing under the force of gravity tracks the low side thereby providing low side stabilization. As the prior describes, a rotary steerable tool requires a method to direct or offset the bit while referencing that direction or offset to a stable reference within the borehole.

It is possible to use a rotary steerable tool that is stabilized by an internal gravity or inertia referenced feedback control system (such as an accelerometer) or by use of an anti-rotational device that engages the wellbore. Thus, the instant device may be used in the device envisioned by the inventors as an improved cam within the tool of referenced U.S. patents or within a new class of rotary steerable tool.

It should be noted that pattern and number of "petals" in the pattern are set by the relationship between a, b, and c in the above equation. Thus, it is up to the imagination of the user as to a choice of patterns. This could prove useful in computer controlled milling machines and the like. Thus, the rotary vector, gear (cycloid) system can find use in a myriad of applications outside the oil and gas industry, FIGS. 10A through 10F show several example patterns along with required parameter values. These figures also illustrate why the pattern of FIG. 4 is preferred for use in rotary drilling because this pattern (or choice of parameters) results in a successive (or sequential) progression of axis motion and returns to zero many times.

Although the device has been described for preferred use in a rotary steerable tool as used in the drilling industry, the device is capable of use in any equipment wherein controlled position is required. Therefore the above description should not be read as a limitation, but as the best mode embodiment and description of the device.

The invention claimed is:

1. A rotary vector gear for sequencing a controlled axis about a reference axis, comprising:

a concentric drive sleeve adapted to rotate about the reference axis;

a first stage eccentric sleeve connected to said driven inner sleeve;

a second stage eccentric sleeve adapted to rotate about the controlled axis;

an external tooth cycloid disc attached to said second stage eccentric;

an internal tooth stationary cycloid ring adapted to be attached to an outer housing for retaining the cycloid system; and, drive means for rotating said concentric drive sleeve.

2. The device of claim 1 further comprising control means for operating said drive means and thereby sequencing said controlled axis in a predictable manner.

3. The device of claim 2 wherein said outer housing is the outer housing of a rotary steerable tool having two ends adapted for use in a wellbore and further adapted to receive a drillstring and wherein said cycloid system provides an offset to the drillstring from the center of the wellbore thereby resulting in bit point or bit push directional steering set by the configuration of the cycloid system contained within the rotary steerable tool.

4. The device of claim 3 wherein said configuration comprises a single cycloid system positioned near the mid point and between two spherical bearings positioned at the ends of said rotary steerable tool thereby providing angular change of to said drillstring resulting in bit point directional steering.

5. The device of claim 3 wherein said configuration comprises two co-joined cycloid systems respectively positioned near the ends of the rotary steerable tool thereby providing axial offset to said drillstring resulting in bit push directional steering.

6. The device of claim 3 wherein said configuration comprises a single cycloid system positioned near one end of the rotary steerable tool and further comprises a spherical bearing positioned the other end of the rotary steerable tool thereby providing angular change to said drillstring resulting in bit point directional steering.

7. The device of claim 3 wherein said rotary steerable tool incorporates an inertial guidance system adapted to provide wellbore position reference and wherein said control system is adapted to communicate with said rotary steerable tool.

8. The device of claim 7 wherein said rotary steerable tool is further adapted to communicate with the surface thereby providing on demand directional steering while controlling the dog-leg, severity of said directional steering.

9. The device of claim 1 wherein the controlled axis moves in a hypotrochoidic pattern with respect to the reference axis whenever said concentric drive sleeve is rotated by said drive.

10. The device of claim 1 wherein said control means is further adapted to retain the relative position of the controlled axis with respect to the reference axis and respond to external signals whereby the controlled axis may be further placed in a known position with respect to the reference axis.

11. A rotary vector gear for sequencing a controlled axis about a reference axis within a wellbore, comprising:

a concentric drive sleeve adapted to rotate about the reference axis;

a first stage eccentric sleeve connected to said driven inner sleeve;

a second stage eccentric sleeve adapted to rotate about the controlled axis;

an external tooth cycloid disc attached to said second stage eccentric;

an internal tooth stationary cycloid ring adapted to be attached to the inside of the outer housing of a rotary steerable downhole tool having a central longitudinal;

a drive means for rotating said concentric drive sleeve; and, control means for operating said drive means and thereby sequencing said controlled axis in a predictable manner wherein the rotary steerable housing contains said drive means and said control means and wherein said controlled axis and the central axis of the wellbore are superimposed one to the other.

12. The device of claim 11 wherein said cycloid system provides bit point or bit push directional steering set by the configuration of the cycloid system contained within the rotary steerable tool.

13. The device of claim 12 wherein said rotary steerable tool is adapted to receive a drill string and wherein said outer housing of said rotary steerable tool has two ends and wherein said configuration comprises a single cycloid system positioned near the mid point and between two spherical bearings positioned at the ends of said rotary steerable tool thereby providing angular change of to said drillstring, resulting the bit point directional steering.

14. The device of claim 12 wherein said configuration comprises two co-joined cycloid systems respectively positioned near the ends of the rotary steerable tool thereby providing bit push directional steering.

15. The device of claim 12 wherein said configuration comprises a single cycloid system positioned near one end of the rotary steerable tool and further comprises a spherical bearing positioned the other end of the rotary steerable tool thereby providing bit point directional steering.

16. The device of claim 11 wherein said control system incorporates sensors adapted to provide wellbore reference data and wherein said control system may make real-time adjustments to said controlled axis thereby influencing the wellbore path.

17. The device of claim 16 wherein said control system incorporates a command protocol so that adjustments in wellbore path may be commanded from the surface.

18. The device of claim 17 wherein the dog-leg severity of the wellbore path is controlled.

19. A rotary vector gear for sequencing a controlled axis about a reference axis adapted for use within a rotary steerable tool wherein the rotary steerable tool is adapted for use in a wellbore and provides control of the wellbore path, comprising:

a concentric drive sleeve adapted to rotate about the reference axis;

a first stage eccentric sleeve connected to said driven inner sleeve;

a second stage eccentric sleeve adapted to rotate about the controlled axis;

an external tooth cycloid disc attached to said second stage eccentric;

an internal tooth stationary cycloid ring adapted to be attached to the inside of the outer housing of a rotary steerable downhole tool having a central longitudinal;

a drive means for rotating said concentric drive sleeve;

control means for operating said drive means and thereby sequencing said controlled axis in a predictable manner thereby controlling the dog-leg severity of the wellbore path; and, wherein said controlled axis and the central axis of the wellbore are superimposed one to the other, wherein the rotary steerable housing contains said drive means and said control means, and wherein said control system incorporates sensors adapted to provide wellbore reference data and wherein said control system may make real-time adjustments to said controlled axis thereby controlling the wellbore path.

20. The device of claim 19 wherein said control system incorporates a command protocol so that adjustments in wellbore path may be commanded from the surface.

21. The device of claim 20 wherein adjustments to dog-leg severity may be made from the surface.

* * * * *